US008946577B2

(12) United States Patent
Bauer et al.

(10) Patent No.: US 8,946,577 B2
(45) Date of Patent: Feb. 3, 2015

(54) AUXILIARY SWITCH FOR AN ELECTRICAL SWITCH

(75) Inventors: Günter Bauer, Sulzbach-Ros. (DE); Michael Freimuth, Hirschau (DE); Jakob Fuchs, Auerbach (DE); Jürgen Renner, Traβlberg (DE)

(73) Assignee: Siemens Aktiengesellschaft, Munich (DE)

( * ) Notice: Subject to any disclaimer, the term of this patent is extended or adjusted under 35 U.S.C. 154(b) by 292 days.

(21) Appl. No.: 13/491,788

(22) Filed: Jun. 8, 2012

(65) Prior Publication Data

US 2012/0312675 A1 Dec. 13, 2012

(30) Foreign Application Priority Data

Jun. 9, 2011 (DE) ..... 10 2011 077 285

(51) Int. Cl.
*H01H 3/42* (2006.01)
*H01H 71/46* (2006.01)

(52) U.S. Cl.
CPC ..... *H01H 71/462* (2013.01); *H01H 2071/467* (2013.01)
USPC ..... 200/573

(58) Field of Classification Search
CPC ..... H01H 2071/467; H01H 71/462; H01H 15/102; H01H 3/42; H01H 15/107; H01H 15/105; H01H 19/63
USPC ..... 200/573, 18, 50.01–50.04, 330, 400, 200/401; 335/8–10, 13, 17; 337/45–50, 79
See application file for complete search history.

(56) References Cited

U.S. PATENT DOCUMENTS

| | | | | |
|---|---|---|---|---|
| 4,754,245 | A | 6/1988 | Toda et al. | |
| 5,107,236 | A * | 4/1992 | Lesslie et al. | 335/132 |
| 5,774,031 | A * | 6/1998 | Linzenich et al. | 335/172 |
| 6,359,244 | B1 * | 3/2002 | Freimuth | 200/50.4 |
| 6,548,769 | B2 | 4/2003 | Nomura et al. | |

FOREIGN PATENT DOCUMENTS

| | | | |
|---|---|---|---|
| DE | 3726175 | A1 | 2/1988 |
| DE | 10137422 | C1 | 11/2002 |
| DE | 102005022230 | A1 | 11/2006 |
| DE | 10117066 | B4 | 8/2008 |
| EP | 2328166 | A1 | 6/2011 |

OTHER PUBLICATIONS

German Office Action for German Application No. 10 2011 077 285.5 dated Jan. 16, 2012.

* cited by examiner

*Primary Examiner* — Edwin A. Leon
(74) *Attorney, Agent, or Firm* — Harness, Dickey & Pierce, P.L.C.

(57) ABSTRACT

In at least one embodiment, an auxiliary switch includes a rotation part and a switching lever assigned to a configuration of the auxiliary switch, the switching lever being embodied to detect a switching state of the electrical switch and transmit it to the rotation part. Further, different switching states of the auxiliary switch are set by different rotary positions of the rotation part, with the rotation part having at least two engagement points and with the switching lever assigned to a configuration engaging in the engagement point assigned to this configuration.

18 Claims, 6 Drawing Sheets

AUXILIARY SWITCH FOR AN ELECTRICAL SWITCH

PRIORITY STATEMENT

The present application hereby claims priority under 35 U.S.C. §119 to German patent application number DE 10 2011 077 285.5 filed Jun. 9, 2011, the entire contents of which are hereby incorporated herein by reference.

FIELD

At least one embodiment of the invention is directed to an auxiliary switch for an electrical switch.

BACKGROUND

Electrical switches are used for switching electric currents. One class of electrical switches is what are referred to as power switches, which can typically switch currents of 100 A and more.

Power switches are typically accommodated in a housing. The individual phases of the currents are typically switched in what are referred to as pole cassettes. To this end a pole cassette comprises a housing in which are accommodated one movable contact and one fixed contact, which can be mechanically moved apart or bought together for switching off or switching on the currents. When the fixed and movable contact of a pole cassette are moved apart an arc occurs, which is typically extinguished in what is referred to as an extinction chamber.

The arc ionizes the gas of the extinction chamber and generates an overpressure in the extinction chamber which is equivalent to the arc energy. The ionized gas which heats up greatly during ionization, because of the overpressure generated, can flow out of the extinction chamber through the exhaust ducts provided for the purpose.

Also known are power switches which do not contain any pole cassettes but contain movable and fixed contacts directly in their housing. The pole cassettes of the individual phases of the currents are coupled to one another by means of a so-called switching shaft. The effect of this switching shaft is that, on detection of a short circuit in one phase and thus in one pole cassette and the opening of movable and fixed contact of this pole cassette, the other pole cassettes are likewise tripped. In addition the switching shaft ensures that all phases of a power switch can be mechanically switched on or switched off by means of a handle. For power switches without pole cassettes movable and fixed contact of the individual phases are likewise coupled to one another via a switching shaft.

What are referred to as auxiliary switches are also accommodated in the housing of a power switch—if necessary next to the pole cassettes. These auxiliary switches interact with the different components of a power switch for interrogation or analysis of the states of these components.

For example the auxiliary switch can interact with the handle of the power switch and interrogate the position of the handle of the power switch and for example forward the results of the interrogation electrically to a subordinate device in the power switch or externally.

Previous power switches have been constructed so that they are optimized for their function of interrogating or analyzing the position of a component of the power switch. Different auxiliary switches, which are tailored in each case to the elements to be interrogated or to be analyzed, have thus been required for different interrogations or analyses of different components of a power switch. This has meant that previously a comprehensive range of auxiliary switches in different mechanical designs has had to be kept in stock for each power switch type.

SUMMARY

At least one embodiment of the invention provides an auxiliary switch for an electrical switch which can be easily tailored in its configurations to the element of the power switch to be interrogated or analyzed.

The auxiliary switch for an electrical switch of at least one embodiment comprises a rotation part and a switching lever assigned to a configuration of the auxiliary switch, with the switching lever being embodied to detect a switching state of the electrical switch and transmit it to the rotation part, and with different switching states of the auxiliary switch being set by different rotary positions of the rotation part, with the rotation part having at least two engagement points, and with the switching lever assigned to a configuration engaging with the engagement point assigned to this configuration.

BRIEF DESCRIPTION OF THE DRAWINGS

The invention is described below with reference to the following figures, in which.

Figure 1:
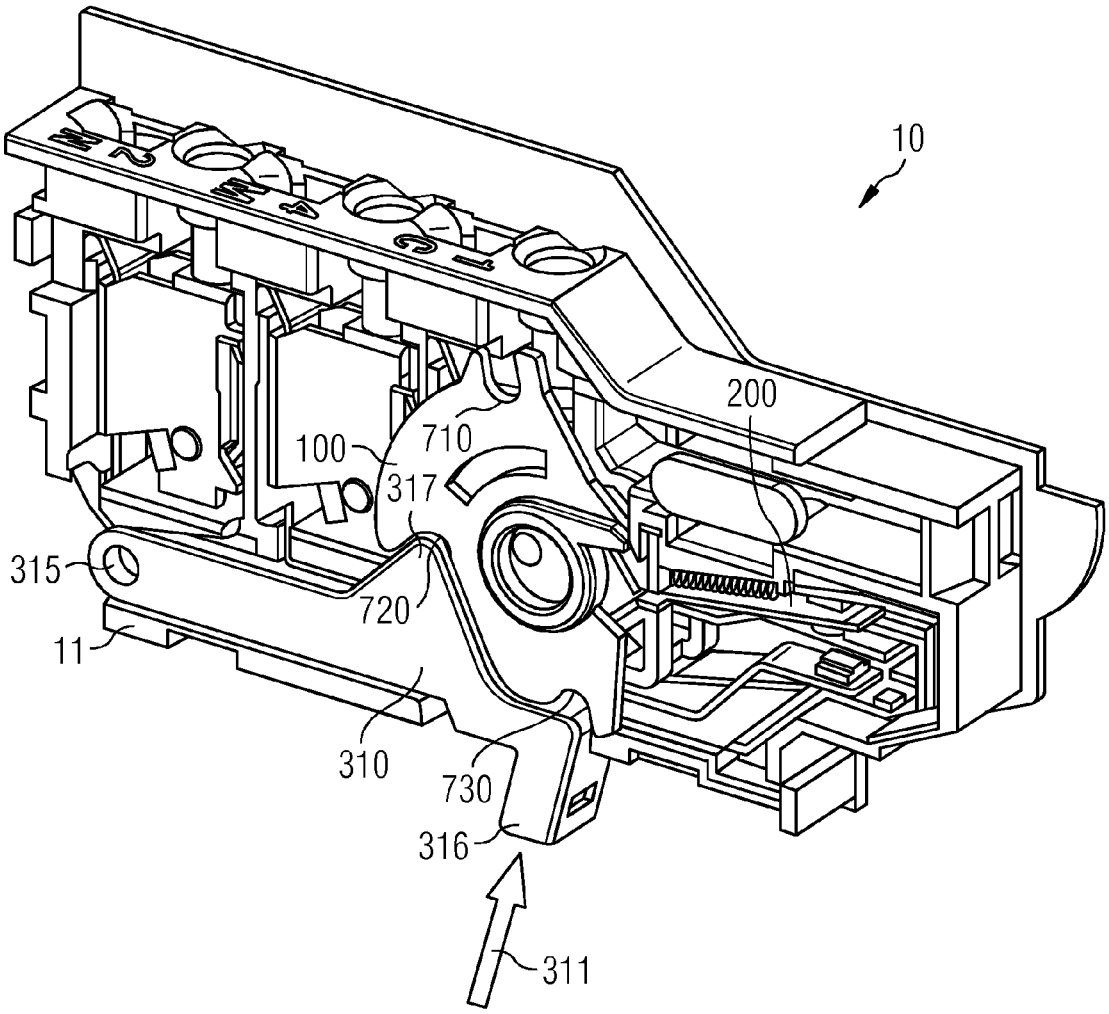
FIG. 1 shows an auxiliary switch with rotation part and a switching lever assigned to a first configuration of the auxiliary switch.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

It is advantageous, in at least one embodiment, for the auxiliary switch to be able to be reconfigured by the insertion of a switching lever assigned to a configuration of the auxiliary switch. This means that different auxiliary switch variants can be realized in one housing. No other adapter parts are necessary for installing the auxiliary switch and the different auxiliary switch variants have a uniform appearance for the customer on the connection side. It is also advantageous that the repeated parts of the individual variants can be bundled together in large numbers.

In one embodiment of the invention the auxiliary switch comprises a switching lever which is embodied as a push or pull element. This push or pull element can be provided with a pin on one side which is embodied to engage in the switching mechanism of the electrical switch.

In a further embodiment of the invention the push or pull element is embodied, on its side facing away from the rotation point, to interact with a magnetic latch or a switching lock of the electrical switch to engage in the switching mechanism of the electrical switch.

In a further embodiment of the invention the switching lever is supported at a first end rotatably on the housing of the auxiliary switch, embodied at a second end to engage in the switching mechanism of the electrical switch, and at a third end the switching lever engages in the engagement point assigned to the configuration of the switching lever. The switching lever can be embodied, on its side facing away from the rotation part, to interact with a switching shaft or with a cam of a switching shaft of the electrical switch for engaging in the switching mechanism of the electrical switch.

The auxiliary switch can additionally comprise a housing. The housing can comprise a coding which ensures that the auxiliary switch can only be installed at a position on the electrical switch intended for this purpose. The coding can be formed by raised sections which are embodied to engage in recess sections of the electrical switch or by depressions which are embodied to engage in raised sections of the electrical switch.

In a further embodiment of the invention the switching lever is embodied to detect a switching state of a thermal-magnetic tripping unit or an electrical tripping unit or a power switch switching lock.

FIG. 1 shows an example embodiment of an auxiliary switch 10 for an electrical switch. The auxiliary switch 10 comprises a rotation part 100 and a switching lever 310 assigned to a first configuration of the auxiliary switch 10, with the switching lever 310 being embodied to detect a switching state of the electrical switch and transmit it to the rotation part 100, and with different switching states of the auxiliary switch 10 able to be set by different rotary positions of the rotation part 100. The rotation part 100 comprises three engagement points 710, 720, 730 in total. The switching lever 310 assigned to a first configuration engages in the engagement point 720 assigned to this configuration.

The switching lever 310 is supported at a first end 315 rotatably on the housing 11 of the auxiliary switch 10. At a second end 316 the switching lever 310 is embodied so that it can engage in the switching mechanism of the electrical switch. At a third end 317 of the switching lever 310 said lever engages in the engagement point 720 assigned to the first configuration of the switching lever 310. The second end 316 of the switching lever 310 can for example interact with a switching shaft of a power switch. This means for example that cams on the switching shaft or the switching shaft itself, on switching of the power switch, actuate the second end 316 of the switching lever 310 and move it in the direction 311. The rotation part 100 is turned in a clockwise direction by this and is brought into a rotary position, which for example electrically switches the switching mechanism 200 of the auxiliary switch 10.

The auxiliary switch 10 typically has two switching positions, namely "ON" and "OFF". By contrast electrical switches typically have a number of switching positions, e.g. a power switch "ON", "OFF", "TRIPPED" and "RESET". The auxiliary switch 10 analyzes the switching position of the electrical switch, with the possibly more than two switching positions of the electrical switch being mapped to the typically two switching positions of the auxiliary switch 10.

The first configuration makes it possible for the auxiliary switch 10 and the interaction of the second end 316 of the auxiliary switch 310 with the switching mechanism of the electrical switch, e.g. the switching shaft or the cams of a switching shaft, to detect the status of the power switch and implement it electrically for example in the switching mechanism 200, and either to display this state itself and transmit it to further devices.

Figure 2:
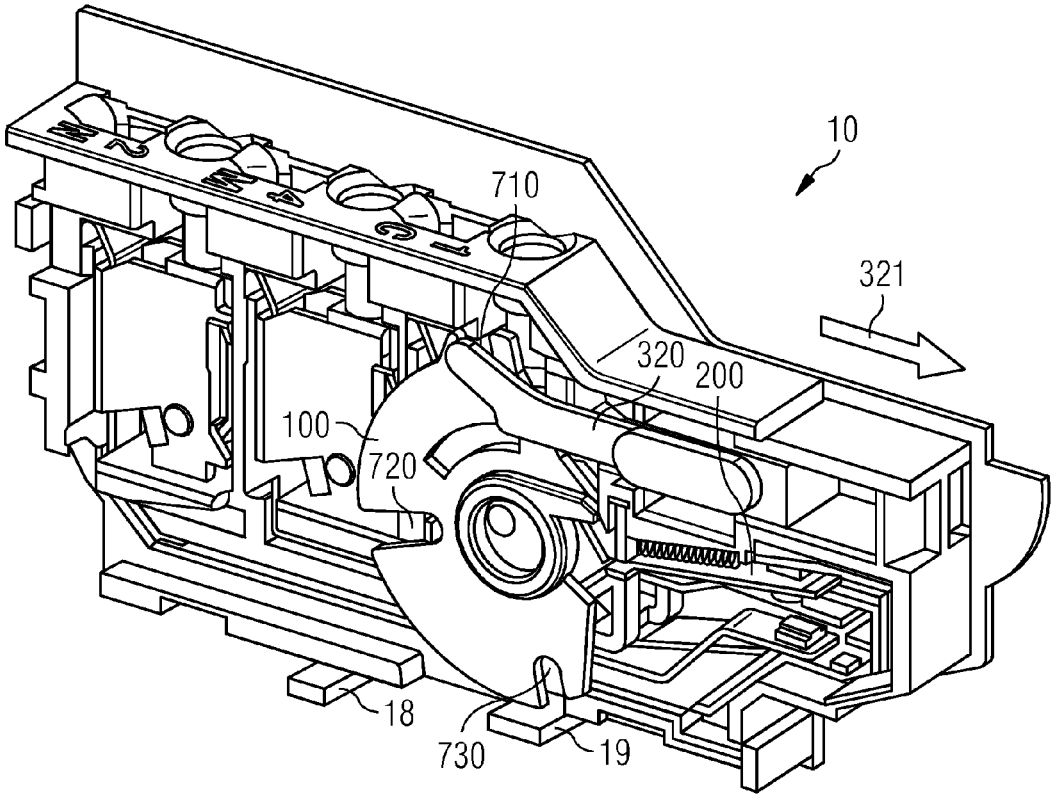
FIG. 2 shows an auxiliary switch with rotation part and a switching lever assigned to a second configuration of the auxiliary switch.

FIG. 2 shows an auxiliary switch 10 for an electrical switch with a rotation part 100 and a switching lever 320 assigned to a second configuration of the auxiliary switch 10. Like the switching lever 310 of FIG. 1 the switching lever 320 is embodied so that it can turn the rotation part 300 and can thus set a different rotary position of the rotation part 100. The switching lever 320 engages in the engagement point 710 assigned to the second configuration. The rotation part 100 has a total of three engagement points 710, 720, 730 overall, with only the engagement point 710 being occupied by a switching lever in the second configuration of the auxiliary switch 10.

The switching lever 320 is embodied as a push or pull element which engages in the rotation part 100, in the second configuration of the auxiliary switch 10 into the engagement point 710.

The push or pull element 320 can be provided with a pin on its side which is embodied to engage in the switching mechanism of the electrical switch. The pin of the push or pull element 320 is not shown in FIG. 2, it is located in the diagram shown in FIG. 2 on the rear side of the auxiliary switch 10. The pin can for example be engaged with the handle of a power switch. If the electrical switches is switched on at the power switch handle for example, the handle moves and this movement is translated to the pin of the push or pull element 320. The push or pull element 320 is thus moved in the direction 321, the rotation part 100 is moved through this in the diagram in accordance with FIG. 2 in a clockwise direction and is moved into a rotary position which switches the switching mechanism 200 of the auxiliary switch 10.

Figure 3:
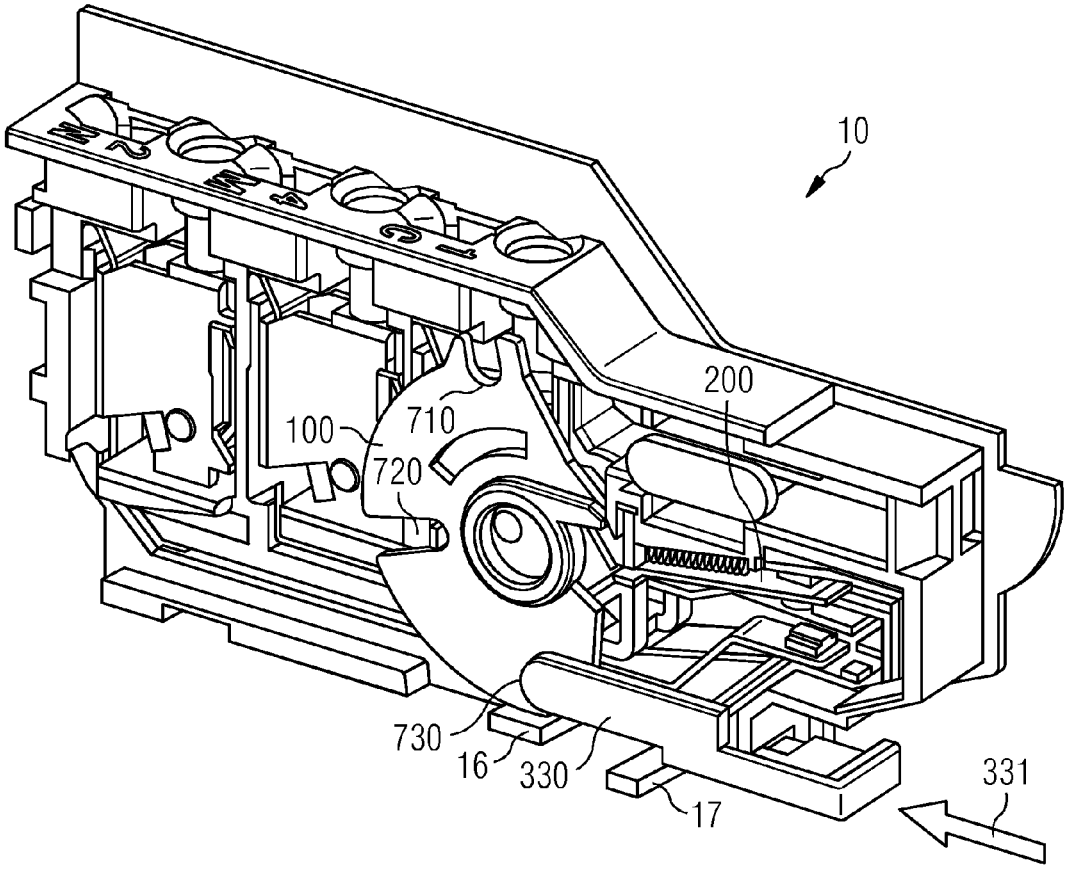
FIG. 3 shows an auxiliary switch with rotation part and a switching lever assigned to a third configuration of the auxiliary switch.

Shown in FIG. 3 is the auxiliary switch 10 for an electrical switch with a rotation part 100 and a switching lever 330 assigned to a third configuration of the auxiliary switch 10. The rotation part 100 has three engagement points 710, 720, 730 overall. The switch lever 330, which is assigned to the third configuration of the auxiliary switch 10, engages in the engagement point 730 assigned in this configuration. The other two engagement points 710, 720 are not occupied in the third configuration of the auxiliary switch 10. The switching lever 330 is likewise embodied as a push or pull element. The side of the push or pull element 330 facing away from the rotation part 100 can for example interact with the switching lock or an electrical switch. Thus, when the electrical switch is tripped, the switching lock can move the push or pull element 330 in direction 331, so that the rotation part 100 is rotated in a clockwise direction and is bought into a rotary position which actuates the switch mechanism 200 of the auxiliary switch 10.

Figure 4:
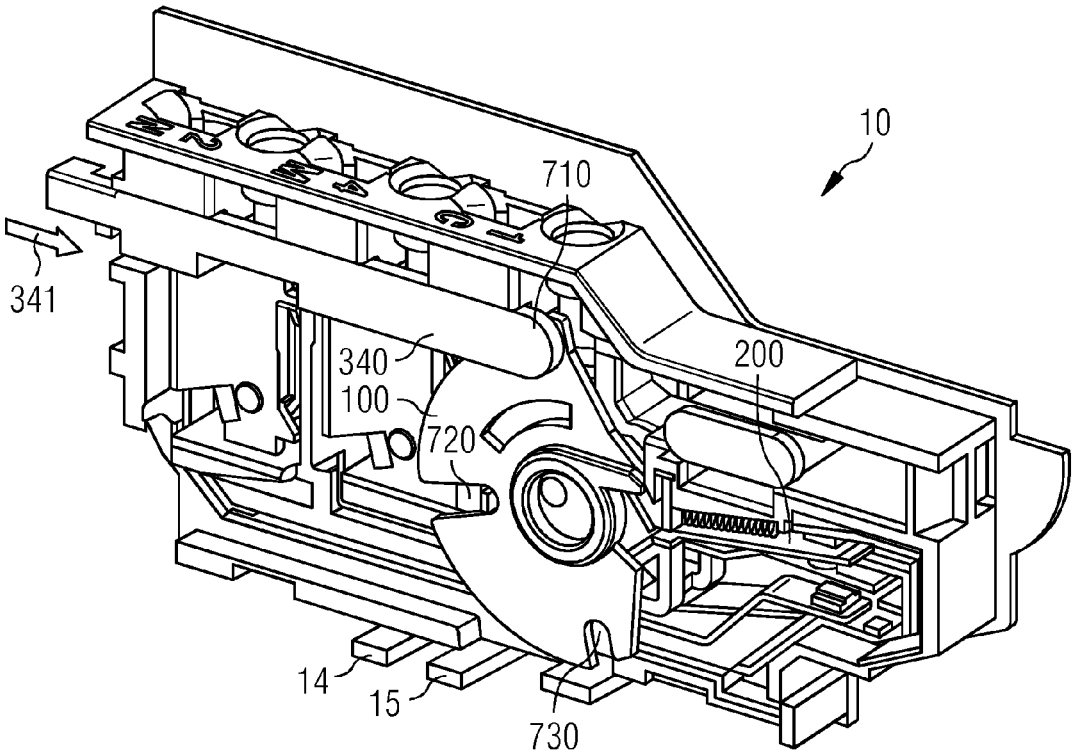
FIG. 4 shows an auxiliary switch with rotation part and a switching lever assigned to a fourth configuration of the auxiliary switch.

FIG. 4 shows an auxiliary switch 10 for an electrical switch with a rotation part 100 and a switching lever 340 assigned to a fourth configuration of the auxiliary switch 10. The rotation part 100 comprises three engagement points 710, 720, 730. The switching lever 340 assigned to the fourth configuration engages into the engagement point 710 assigned to this configuration. It is thus possible for one engagement point to be assigned to different configurations of the auxiliary switch 10. For example the engagement point 710 is assigned to the fourth configuration in accordance with FIG. 4 and the second configuration in accordance with FIG. 2.

The switching lever 340 is once again embodied as a push or pull element. The push or pull element 340 can interact with a magnetic latch or a switching lock of an electrical switch on its side facing away from the rotation part 100 to engage in the switching mechanism of the electrical switch. When the power switch is tripped the push or pull element 340 can be pressed in the direction 341 via the magnetic latch or the switch block of the electrical switch, which moves the rotation part 100 in the clockwise direction and brings it into a rotary position to switch the switching mechanism 200 of the auxiliary switch 10. In this fourth configuration of the auxiliary switch 10 the engagement points 720 and 730 are not occupied.

The inventive device of at least one embodiment is explained on the basis of three engagement points 710, 720, 730 on the rotation part 100. The inventive device can however have more than these three engagement points, inventively there is provision for at least two engagement points.

The different configurations of the auxiliary switch 10 make possible the interrogation of the switch position and analysis position of the power switch by the auxiliary switch. In such cases the configuration can consist of interrogating the switch position of the power switch, interrogating the trip position of the switching lock, interrogating the trip position of the Electronic Trip Unit (ETU), interrogating the switching-off movement before the main contacts are switched off, interrogating the switching-on movement before the main contacts are switched on or interrogating a short circuit occurring in the power switch. The different configurations of the auxiliary switch 10 are mapped in each case with an assigned switching lever and an engagement point in the rotation part 100 assigned to this configuration.

The auxiliary switches in the second, third and fourth configuration corresponding to FIGS. 2, 3 and 4 also have a coding 14, 15, 16, 17, 18, 19 on the housing 11 which ensures that the auxiliary switch 10 can only be installed on the electrical switch in a position intended for it. The codings can be formed by raised sections. In FIG. 2 these raised sections 18, 19 are embodied so that, in the second configurations of the auxiliary switch 10, the auxiliary switch can only be installed on the electrical switch in a position provided for it. In accordance with the previously described functionality of the second configuration of the auxiliary switch 10, this means that the auxiliary switch 10 can only be installed so that the handle of the power switch can interact with the switching lever 322 to actuate the auxiliary switch 10. The same applies to the codings 16, 17 in accordance with FIG. 3 in the third configuration of the auxiliary switch 10 and for the raised sections 14, 15 in FIG. 4 in accordance with the fourth configuration of the auxiliary switch 10.

The coding of the auxiliary switch 10 by the raised sections 14, 15, 16, 17, 18, 19 can additionally be visually supported by a colored identification. For example the configurations of the auxiliary switch can each be provided with different colors. The raised sections 14, 15, 16, 17, 18, 19 additionally ensure that the auxiliary switch can only be installed on the electrical switch at the position provided for it.

The description has referred to the coding being formed by raised sections which are embodied so as to be able to engage in recesses of the electrical switch. However it is just as possible for the coding to be formed by recesses which are embodied to be able to engage in raised sections of the electrical switch.

The raised sections or recesses of the coding are molded onto the housing floor of the auxiliary switch 10.

Figure 5:
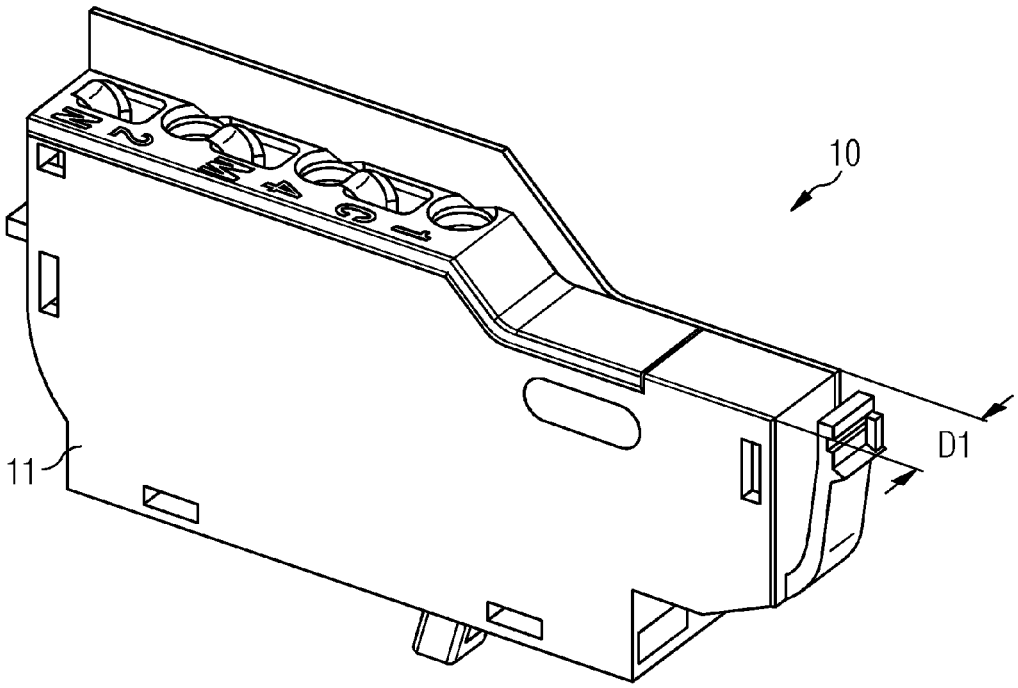
FIG. 5 shows an auxiliary switch with an enclosed housing in a first size of auxiliary switch.
Figure 6:
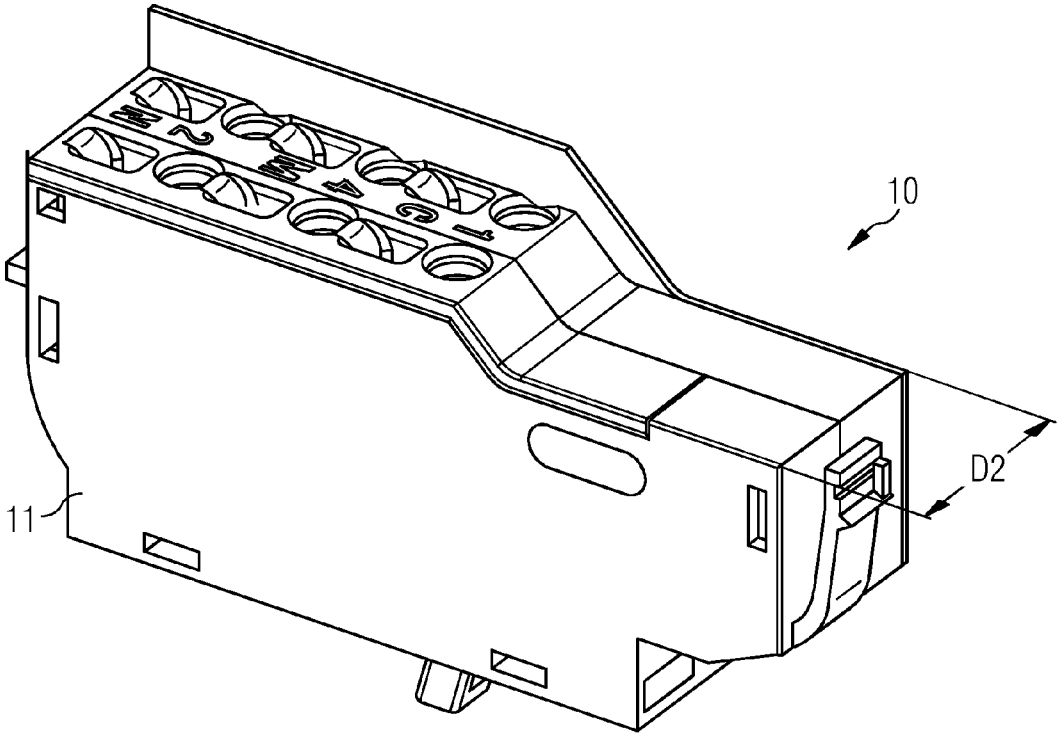
FIG. 6 shows an auxiliary switch with an enclosed housing in a second size of auxiliary switch.

FIGS. 5 and 6 show the auxiliary switch 10 after the installation of the outer cover. In accordance with FIG. 5 the auxiliary switch 10 has a thickness D1 and in accordance with FIG. 6 a thickness D2. Embodiments of the inventive auxiliary switch 10 can thus be manufactured especially easily in different sizes.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An auxiliary switch for an electrical switch comprising:

a rotation part; and at least one switching lever assigned to a configuration of the auxiliary switch, the at least one switching lever being embodied to detect a switching state of the electrical switch and to transmit the switching state to the rotation part, different switching states of the auxiliary switch being set by different rotary positions of the rotation part, and the rotation part including at least two engagement points formed of notches within an edge surface of the rotation part, the at least one switching lever engaging in a respective one of the notches assigned to the configuration.

2. The auxiliary switch of claim 1, wherein the at least one switching lever is embodied as a push or pull element which engages in the rotation part.

3. The auxiliary switch of claim 2, wherein the push or pull element is provided with a pin, embodied to engage in a switching mechanism of the electrical switch.

4. An auxiliary switch for an electrical switch comprising:

a rotation part; and at least one switching lever assigned to a configuration of the auxiliary switch, the at least one switching lever being embodied to detect a switching state of the electrical switch and to transmit the switching state to the rotation part, different switching states of the auxiliary switch being set by different rotary positions of the rotation part, and the rotation part including at least two engagement points, the at least one switching lever engaging in a respective one of the at least two engagement points assigned to the configuration, wherein the at least one switching lever is embodied as a push or pull element which engages in the rotation part, the push or pull element is provided with a pin, embodied to engage in a switching mechanism of the electrical switch, and the push element is embodied, on a side facing away from the rotation part, to be interactable with a magnetic latch or a switching lock of the electrical switch to engage in the switching mechanism of the electrical switch.

5. The auxiliary switch of claim 1, wherein the switching lever is supported at a first end rotatably on the housing of the auxiliary switch, is embodied at a second end to be engagable in a switching mechanism of the electrical switch, and at a third end engages in the engagement point assigned to the configuration.

6. The auxiliary switch of claim 5, wherein the switching lever, on a side facing away from the rotation part, is embodied to be interactable with a switching shaft or a cam of a switching shaft of the electrical switch to engage in the switching mechanism of the electrical switch.

7. The auxiliary switch of claim 1, further comprising a housing.

8. The auxiliary switch of claim 7, wherein the housing comprises a coding which ensures that the auxiliary switch can only be installed on the electrical switch at a position provided for the auxiliary switch.

9. The auxiliary switch of claim 8, wherein the coding is formed by raised sections which are embodied to be engagable into recesses of the electrical switch or by depressions which are embodied to be engagable in raised sections of the electrical switch.

10. The auxiliary switch of claim 1, wherein the switching lever is embodied to detect a switching state of a thermal-magnetic tripping unit, an electrical tripping unit or a power switch.

11. The auxiliary switch of claim 3, wherein the switching lever is supported at a first end rotatably on the housing of the auxiliary switch, is embodied at a second end to be engagable in the switching mechanism of the electrical switch, and at a third end engages in the engagement point assigned to the configuration.

12. The auxiliary switch of claim 4, wherein the switching lever is supported at a first end rotatably on the housing of the auxiliary switch, is embodied at a second end to be engagable in the switching mechanism of the electrical switch, and at a third end engages in the engagement point assigned to the configuration.

13. The auxiliary switch of claim 11, wherein the switching lever, on a side facing away from the rotation part, is embodied to be interactable with a switching shaft or a cam of a switching shaft of the electrical switch to engage in the switching mechanism of the electrical switch.

14. The auxiliary switch of claim 12, wherein the switching lever, on a side facing away from the rotation part, is embodied to be interactable with a switching shaft or a cam of a switching shaft of the electrical switch to engage in the switching mechanism of the electrical switch.

15. The auxiliary switch of claim 2, further comprising a housing.

16. The auxiliary switch of claim 15, wherein the housing comprises a coding which ensures that the auxiliary switch can only be installed on the electrical switch at a position provided for the auxiliary switch.

17. The auxiliary switch of claim 16, wherein the coding is formed by raised sections which are embodied to be engagable into recesses of the electrical switch or by depressions which are embodied to be engagable in raised sections of the electrical switch.

18. The auxiliary switch of claim 2, wherein the switching lever is embodied to detect a switching state of a thermal-magnetic tripping unit, an electrical tripping unit or a power switch.

* * * * *